US007219522B2

(12) United States Patent
Maeda et al.

(10) Patent No.: US 7,219,522 B2
(45) Date of Patent: May 22, 2007

(54) OVAL CROSS SECTION METAL TUBE PRODUCING DEVICE AND PRODUCING METHOD

(75) Inventors: Yuji Maeda, Hadano (JP); Sigetomi Miyoshi, Ibaraki (JP); Takahiro Yamaguchi, Ibaraki (JP)

(73) Assignee: Taisai Kako Co., Ltd. (JP)

( * ) Notice: Subject to any disclaimer, the term of this patent is extended or adjusted under 35 U.S.C. 154(b) by 154 days.

(21) Appl. No.: 10/522,217

(22) PCT Filed: Jul. 25, 2003

(86) PCT No.: PCT/JP03/09419

§ 371 (c)(1),
(2), (4) Date: Jan. 24, 2005

(87) PCT Pub. No.: WO2004/011167

PCT Pub. Date: Feb. 5, 2004

(65) Prior Publication Data

US 2005/0247097 A1 Nov. 10, 2005

(30) Foreign Application Priority Data

Jul. 26, 2002 (JP) ..... 2002-218381

(51) Int. Cl.
*B21C 23/00* (2006.01)

(52) U.S. Cl. ..... 72/254; 72/256; 72/267; 72/273; 72/370.23; 72/379.4

(58) Field of Classification Search ..... 72/254, 72/256, 257, 260, 264, 266, 267, 273, 340, 72/370.01, 370.23, 370.24, 379.4
See application file for complete search history.

(56) References Cited

U.S. PATENT DOCUMENTS

| | | | | |
|---|---|---|---|---|
| 2,161,752 | A * | 6/1939 | Temple | 72/257 |
| 2,162,776 | A * | 6/1939 | Friden | 72/256 |
| 2,533,942 | A * | 12/1950 | Jongedyk | 72/267 |
| 2,979,195 | A * | 4/1961 | Martin | 72/267 |
| 3,415,098 | A * | 12/1968 | Daniels et al. | 72/267 |
| 3,839,890 | A * | 10/1974 | Phlippoteau | 72/68 |
| 4,200,051 | A * | 4/1980 | Nakahara et al. | 72/283 |

FOREIGN PATENT DOCUMENTS

JP 2-65447 5/1990

OTHER PUBLICATIONS

International Search Report, Nov. 11, 2003.

* cited by examiner

*Primary Examiner*—Ed Tolan
(74) *Attorney, Agent, or Firm*—Wood, Phillips, Katz, Clark & Mortimer

(57) ABSTRACT

It is an object of the present invention to provide a novel aluminum tube of an oval cross section that has a wider range of applications and added values. A disk-shaped metal slug (21) is impact-extruded with the use of a die (14) and a punch (13) each having an optimally designed structure to form a metal tube (T) integrally including a mouth, a shoulder and a body of an oval cross section. A hem portion of the oval body of the tube (T) thus formed and hardened by the impact extrusion is once deformed into a circular shape, and then trimmed off by a turning operation.

14 Claims, 18 Drawing Sheets

OVAL CROSS SECTION METAL TUBE PRODUCING DEVICE AND PRODUCING METHOD

This application claims the priority of Japanese Patent Application No. 2002-218381, filed Jul. 26, 2002.

This application is a 35 U.S.C. 371 of PCT/JP03/09719, filed Jul. 25, 2003.

TECHNICAL FIELD OF THE INVENTION

The present invention relates to a metal tube having an oval cross section, and a production apparatus and method for such a metal tube.

BACKGROUND ART

A conventional aluminum tube having an integral outlet mouth is produced by an impact extruding method (impact press). In this method, a disk-shaped aluminum slug punched out of a rolled aluminum plate (having a purity of 99.7% or higher) is used as a material. The slug is put in a die, and pressed by moving a punch toward the die thereby to be instantaneously extruded through a gap defined between the punch and the die owing to its ductility. Thus, the tube is formed. The aluminum tube has the following advantages:

(1) The aluminum tube is excellent in flavor maintaining property and suitable for long-term preservation of contents in the tube, because it is impervious to air and light.
(2) After the contents are squeezed out of the tube, the contents are not sucked back into the tube (with no back flow of air), so that the remaining contents are less likely to contact the air. Therefore, the aluminum tube ensures that the contents maintain a highly stable quality.
(3) The aluminum tube has no seam, so that print can be provided over the entire outer surface of the tube.
(4) The residual amount of the content can easily be detected during use.
(5) With the use of a transparent ink, excellent print can be provided on the tube, taking advantage of the metallic luster of aluminum.

It has been considered that the die and the tube to be formed should each have a circular cross section. This is because the aluminum slug as the material is circular as seen from a front side thereof and is required to be uniformly extruded through the gap defined between the punch and the die circumferentially of the punch for improvement of yield and for reduction of a material loss. Further, it has also been considered impossible to properly handle a metal tube having a noncircular cross section after the press.

Where a tube having an oval cross section is required for improving the design of the tube and increasing the volume of the tube, a plastic tube such as disclosed in Japanese Unexamined Utility Model No. 64-51040 (1989) is used.

DISCLOSURE OF THE INVENTION

It is an object of the present invention to provide a metal tube of a novel shape including a body having an oval cross section to add values to the metal tube.

To achieve the object, the present invention provides the following technical means.

A production apparatus for a metal tube having an oval cross section according to the present invention includes: an impact extrusion device which impact-extrudes a disk-shaped metal slug to form a metal tube integrally including a mouth, a shoulder and a body of an oval cross section; and a trimming device which trims off a hem portion of the oval body of the tube formed by the impact extrusion device by a turning operation. Examples of the metal tube include aluminum tubes, lead tubes, tin tubes and alloy tubes. The metal tube according to the present invention is used in a variety of applications for tooth pastes, medicines, cosmetics, domestic products, food products and the like. The metal slug typically has a circular shape, but may have an oval shape.

In the inventive apparatus, the impact extrusion device includes a columnar punch having an axis, a press die, and a stripper provided around the punch in an axially movable manner. The punch includes a punch shaft, a punch head provided at a distal end of the shaft and including a punch shoulder. The die includes a die base, and a die ring which retains the metal slug therein. The die base and the die ring may be a unitary member or separate members combined together. The punch shoulder has an outer surface having an oval cross section, and the die ring has an inner peripheral surface having an oval cross section. The punch shoulder is insertable in the die ring. A gap is defined between the die ring and the punch shoulder inserted in the die ring circumferentially of the punch shoulder. The metal material is extruded through the gap, whereby the metal tube is allowed to have an oval body.

The punch head includes a base of an oval cross section connected to the punch shaft, the punch shoulder which is provided at a distal end of the base and has a greater diameter than the base, and a first taper surface having an oval cross section which has a diameter progressively decreasing toward a distal end thereof from the punch shoulder. The punch head further includes a punch nose which extends from the distal end of the first taper surface to a distal end of the punch head. The punch shoulder defines an interior surface of the body of the metal tube, and the first taper surface defines an interior surface of the shoulder of the metal tube. The punch nose defines an interior surface of the mouth of the metal tube.

A typical phenomenon liable to occur in a conventional impact extruding process will be described. Where a circular aluminum slug is formed with the use of a circular die by the impact press, a part of the slug corresponding to the hem portion of the metal tube is first extruded. At this time, the hem portion of the tube is undulated due to offset of the axes of the die and the punch and a difference in circularity between the die and the punch. This phenomenon inevitably occurs in the impact press for the formation of the conventional circular tube, and is expected to be exacerbated in the case of the oval tube. That is, when a circular slug is impact-pressed with the use of a die and a punch each having an oval cross section, portions of the aluminum slug present on diametrically opposite sides of the minor axis of the punch are instantaneously extruded, but portions of the aluminum slug present on diametrically opposite sides of the major axis of the punch are extruded with a time lag because of greater distances from the punch shoulder. Therefore, hem portions of the tube on the diametrically opposite sides of the major axis are significantly indented, so that a material loss is significantly increased. Hence, it is necessary to substantially uniformly extrude the aluminum slug on the diametrically opposite sides of the major and minor axes of the punch by optimizing the shape of the head. As a result of intensive studies conducted by the inventors of the present invention, it has been found that generating lines of the first taper surface on diametrically opposite sides of the major axis of the first taper surface preferably each form an angle of not smaller than 55 degrees and not greater than 65 degrees, more preferably not smaller than 58 degrees and not greater than 62 degrees, further more preferably about 60 degrees, with respect to the axis of the punch for substantially uniformly extruding the portions of the slug on the diametrically opposite sides of the major and minor axes. Further, generating lines of the first taper surface on the diametrically opposite sides of the minor axis of the first taper surface preferably each form an angle of not smaller than 43 degrees and not greater than 53 degrees, more preferably not smaller than 46 degrees and not greater than 50 degrees, further more preferably about 48 degrees, with respect to the axis of the punch. The outer surface of the shoulder and the inner peripheral surface of the die ring are each preferably dimensioned so that the dimensional ratio of the minor axis to the major axis thereof is not smaller than 0.5 and not greater than 0.9, more preferably not smaller than 0.6 and not greater than 0.8.

The punch shaft may be columnar with an oval cross section or a circular cross section like the base of the punch head. Where the punch shaft has a circular cross section and the punch head is detachable from the punch shaft, the formation of a metal tube of a circular cross section can be achieved easily and speedily by replacing the punch head and the die with a circular punch head and a circular die, respectively. Where the punch shaft has a circular cylindrical shape, the length of the minor axis of the base of the punch head is equal to the diameter of the punch shaft, and the punch head has second taper surfaces respectively defined on proximal peripheral portions thereof on diametrically opposite sides of the major axis thereof and connected to an outer peripheral surface of the punch shaft. Generating lines of the second taper surfaces on the diametrically opposite sides of the major axis of the punch head each form an angle of not smaller than 10 degrees and not greater than 60 degrees, more preferably 15 degrees to 30 degrees, with respect to the axis of the punch. Thus, the portions of the oval head on the diametrically opposite sides of the major axis are connected to the circular cylindrical shaft by the second taper surfaces, whereby steps can be eliminated which may otherwise be formed on a junction between the head and the shaft to catch the metal tube when the metal tube is released from the punch. This ensures smooth releasing of the metal tube.

The stripper includes a plurality of segments circumferentially arranged. The segments are each radially movable. Distal edges of inner peripheral surfaces of the segments may each have an arcuate shape which conforms to the outer peripheral shape of the base of the punch head. A distal edge of an inner peripheral surface of the stripper (the combined inner peripheral surfaces of the respective segments) has an oval shape which conforms to the outer peripheral shape of the base of the punch head. Where the punch shaft has a circular cylindrical shape, gaps are formed between ones of the segments located on the diametrically opposite sides of the major axis of the stripper and the punch shaft. However, the metal tube can be assuredly removed from the punch by the stripper, because the inner peripheral edge of the stripper is configured so as to conform to the base of the punch head having a slightly smaller diameter than the punch shoulder which defines the interior surface of the tube. Even if the stripper is rotated, the formation of the circular tube is not adversely affected by the rotation of the stripper. In the formation of the inventive oval tube, however, it is necessary to prevent the rotation of the stripper. Therefore, a positioning portion such as a key groove is preferably provided at a predetermined position of a peripheral surface of the stripper. Thus, the stripper is fixed with respect to the direction of the rotation by engaging the positioning portion with a stripper holder.

In the present invention, a biasing member may be provided for biasing the respective segments radially inward. This prevents the respective segments from being subjected to an excess load.

The trimming device includes a mandrel around which the metal tube formed by the impact extrusion device is fitted, the mandrel being rotatable about an axis thereof, and a cutting tool which cuts the hem portion of the metal tube fitted around the mandrel. The mandrel includes a taper portion having a truncated conical shape which has a diameter progressively decreasing toward a distal end thereof. A proximal portion of the taper portion has a diameter greater than the length of the major axis of an inner peripheral surface of the body of the metal tube. The hem portion of the metal tube is cut at an axially middle position of the taper portion by the cutting tool. The hem portion of the metal tube fitted around the mandrel is flared into a circular shape by the taper portion. The metal tube having the flared hem portion is rotated relative to the cutting tool by the rotation of the mandrel, whereby the hem portion of the tube is circumferentially cut by the cutting tool. With this arrangement, the hem portion of the tube having an oval cross section is once deformed into a circular shape, and then cut. Therefore, the cutting operation can be easily performed. The metal tube experiences work hardening during the impact press. Therefore, the metal tube is easily restored into the original oval shape even after being deformed.

Further, the taper portion of the mandrel has a groove provided in an outer peripheral surface thereof in association with the cutting tool as extending circumferentially thereof. Thus, the hem portion can be assuredly cut by permitting the cutting tool to intrude into the groove with an interior surface of the hem portion of the tube being deformed to be fitted around the mandrel.

The inventive production apparatus further includes an annealing device which anneals the metal tube formed and hardened by the impact extrusion performed by the impact extrusion device, and a restoration device which restores the hem portion of the tube deformed into the circular shape by the mandrel of the trimming device into the oval shape. The restoration device may be provided in the annealing device or in the impact extrusion device, or provided between the impact extrusion device and the annealing device. The metal tube with its hem portion restored into the oval shape by the restoration device is annealed by the annealing device. Thus, the metal of the tube having the oval body is softened, and a lubricant applied to the slug for the impact extrusion is evaporated by heat.

A production method for a metal tube having an oval cross section according to the present invention includes the steps of: impact-extruding a disk-shaped metal slug to form a metal tube integrally including a mouth, a shoulder and a body of an oval cross section; and trimming a hem portion of the oval body and the mouth of the tube formed in the impact extrusion step by a turning operation.

In the inventive production method, the impact extrusion step is performed by an impact extrusion device including a columnar punch having an axis, a press die and a stripper provided around the punch in an axially movable manner. The punch includes a punch shaft, and a punch head provided at a distal end of the shaft and including a punch shoulder. The die includes a die base, and a die ring which retains the metal slug therein. The punch shoulder has an outer surface having an oval cross section, and the die ring has an inner peripheral surface having an oval cross section. The punch shoulder is insertable in the die ring.

The punch head includes a base of an oval cross section connected to the punch shaft, the punch shoulder which is provided at a distal end of the base and has a greater diameter than the base, and a first taper surface having an oval cross section which has a diameter progressively decreasing toward a distal end thereof from the punch shoulder. Generating lines of the first taper surface on diametrically opposite sides of the major axis of the first taper surface preferably each form an angle of not smaller than 55 degrees and not greater than 65 degrees with respect to the axis of the punch. Further, generating lines of the first taper surface on diametrically opposite sides of the minor axis of the first taper surface preferably each form an angle of not smaller than 43 degrees and not greater than 53 degrees with respect to the axis of the punch. The outer surface of the shoulder and the inner peripheral surface of the die ring are each preferably dimensioned so that the ratio of the minor axis to the major axis thereof is not smaller than 0.6 and not greater than 0.9.

The punch shaft has a circular cylindrical shape. The length of the minor axis of the base of the punch head is equal to the diameter of the punch shaft, and the punch head has second taper surfaces respectively defined on proximal peripheral portions thereof on diametrically opposite sides of the major axis thereof and connected to an outer peripheral surface of the punch shaft. Generating lines of the second taper surfaces on the diametrically opposite sides of the major axis of the punch head each form an angle of not smaller than 10 degrees and not greater than 60 degrees with respect to the axis of the punch.

The stripper includes a plurality of segments circumferentially arranged. The segments are each radially movable. Distal edges of inner peripheral surfaces of the segments may each have an arcuate shape which conforms to the outer peripheral shape of the base of the punch head. A proximal portion of the metal tube formed to be fitted around the punch by the impact extrusion is pushed toward a distal end of the punch by the stripper, whereby the metal tube is released from the punch. The segments may be moved radially outward or inward to conform to the outer peripheral shape of the punch during the releasing.

Where the segments are biased radially inward during the releasing, the inner peripheral edges of the respective segments are fitted around the hem portion of the tube and, at the same time, an excess load is released radially outward. This prevents breakage of the apparatus.

In the trimming step, the hem portion of the metal tube which is formed and hardened in the impact extrusion step is deformed into a circular shape and, after the hem portion is restored into an oval shape, the metal tube is annealed to be softened.

The trimming step is performed by a trimming device including a mandrel around which the metal tube formed by the impact extrusion device is fitted, the mandrel being rotatable about an axis thereof, and a cutting tool which cuts the body of the metal tube fitted around the mandrel at a predetermined axial position. The mandrel includes a taper portion having a truncated conical shape which has a diameter progressively decreasing toward a distal end thereof. A proximal portion of the taper portion has a diameter greater than the length of the major axis of an inner peripheral surface of the body of the metal tube. The hem portion of the metal tube is cut at an axially middle portion of the taper portion by the cutting tool. The hem portion of the metal tube fitted around the mandrel is flared into a circular shape by the taper portion. The metal tube having the flared hem portion is rotated relative to the cutting tool by the rotation of the mandrel, whereby the hem portion of the tube is circumferentially cut by the cutting tool.

Further, the taper portion of the mandrel has a groove provided in an outer peripheral surface thereof in association with the cutting tool as extending circumferentially thereof. Thus, the cutting tool is permitted to intrude into the groove during the cutting.

The inventive production method further includes the steps of annealing the metal tube which is formed and hardened by the impact extrusion performed by the impact extrusion device, and restoring the hem portion of the tube deformed into the circular shape by the mandrel of the trimming device into the oval shape. The annealing step may follow the restoring step.

The production method has substantially the same features as the inventive production apparatus.

A metal tube having an oval cross section according to the present invention includes a mouth having a circular cross section, a body having an oval cross section, and a tapered shoulder formed integrally with the mouth and the body and connecting the mouth and the body. The inventive production apparatus and the inventive production method make it possible for the first time to produce the metal tube having such a novel shape. The inventive metal tube has advantages as a metal tube and, at the same time, has an increased volume because of the oval cross section of the body thereof. Further, the metal tube with a painted outer surface has an excellent appearance comparable to that of a plastic tube. Since the mouth has a circular cross section, the metal tube has a capping property, an air-tightness in a capped state and a mouth rigidity comparable to those of the existing metal tube. The body and the shoulder each have an oval shape, so that the shoulder can be easily collapsed along the minor axis thereof. Although a metal tube including a mouth, a shoulder and a body integrally formed has a disadvantage such that contents are likely to partly remain in the shoulder of the metal tube, the present invention eliminates this disadvantage. Since the metal tube has an oval shape, a multiplicity of such tubes can be efficiently stored by arranging the tubes in a proper direction.

In the inventive metal tube, generating lines of the shoulder on diametrically opposite sides of the major axis of the shoulder preferably each form an angle of not smaller than 55 degrees and not greater than 65 degrees, more preferably not smaller than 58 degrees and not greater than 62 degrees, further more preferably about 60 degrees, with respect to an axis of the metal tube. Further, generating lines of the shoulder on diametrically opposite sides of the minor axis of the shoulder preferably each form an angle of not smaller than 43 degrees and not greater than 53 degrees, more preferably not smaller than 46 degrees and not greater than 53 degrees, further more preferably about 48 degrees, with respect to the axis of the metal tube. The dimensional ratio of the minor axis to the major axis of the body is preferably not smaller than 0.5 and not greater than 0.9, more preferably not smaller than 0.6 and not greater than 0.8. By thus optimizing the oval shape, the metal material can be more smoothly impact-extruded, and a material loss in the production can be reduced.

Portions of the body on diametrically opposite sides of the minor axis of the body each have a greater wall thickness than portions of the body on diametrically opposite sides of the major axis of the body. Thus, the tube can be easily collapsed along the minor axis.

BEST MODE FOR IMPLEMENTING THE PRESENT INVENTION

Embodiments of the present invention will hereinafter be described with reference to the drawings.

Figure 1:
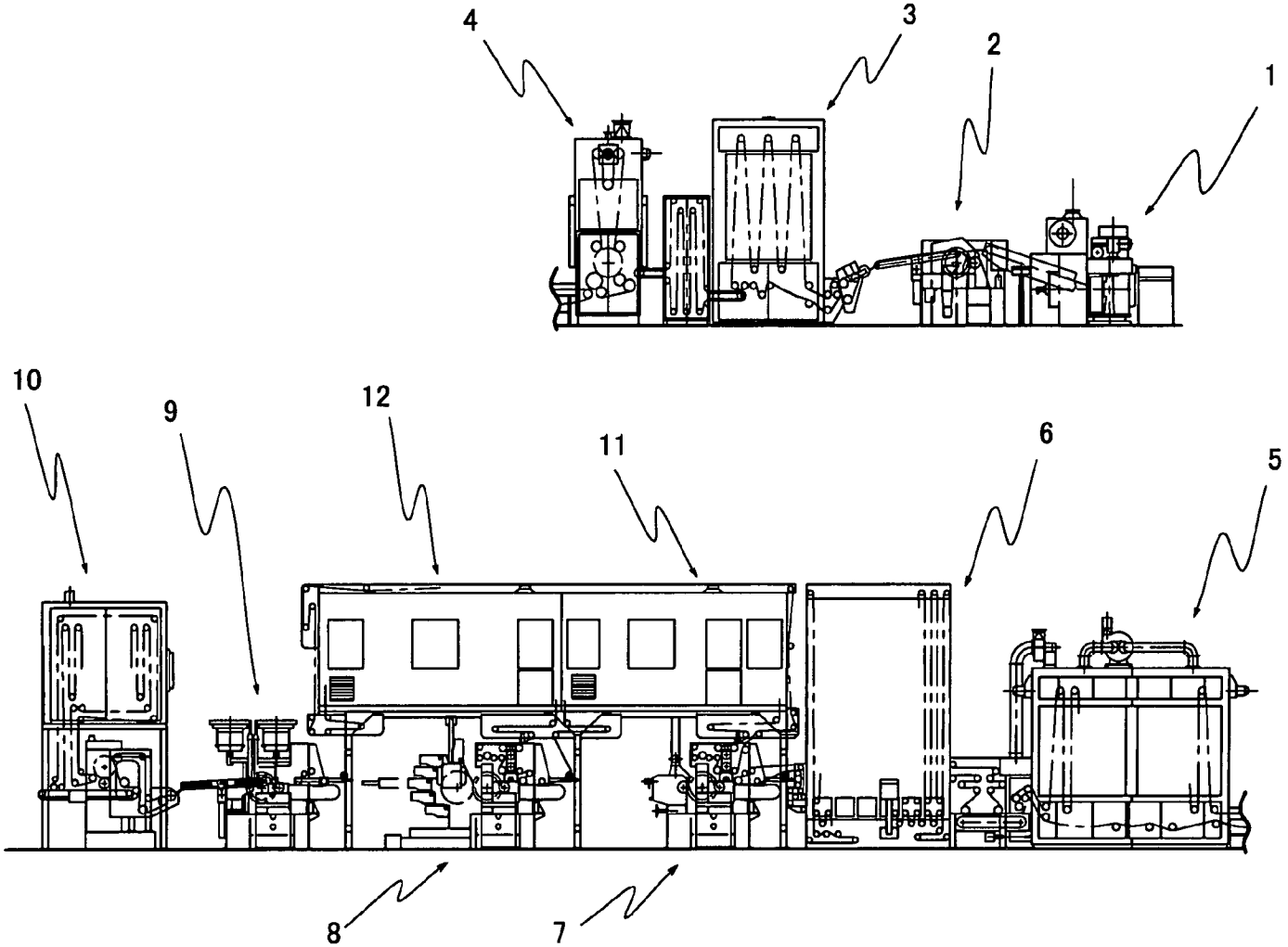
FIG. 1 is a schematic diagram of an overall aluminum tube production apparatus (production line)

FIG. 1 schematically illustrates the overall construction of an aluminum tube production apparatus (production line) as a production apparatus according to one embodiment of the present invention. The production apparatus includes an impact extrusion device 1, a trimming device 2, an annealing device 3, an interior coating device 4, a drying oven 5, an accumulator 6, a prime coating printer 7, an offset printer 8, a capping device 9, and a sealant applying device 10 disposed in this order from an upstream side of the line. The impact extrusion device 1 extrudes an aluminum slug by impact press to form a metal tube integrally including a mouth, a shoulder and a body having an oval cross section. The trimming device 2 trims unnecessary portions of the mouth and the hem portion of the tube formed by the impact press by a turning operation, and forms a thread on an outer circumferential surface of the mouth by a rolling operation. The annealing device 3 reheats the tube hardened in the impact press and then gradually cools the tube after the trimming of the mouth and the hem portion, whereby the tube is softened and a lubricant applied to the slug is evaporated. The interior coating device 4 sprays a predetermined paint on an interior surface of the annealed tube by a spray gun. The drying oven 5 heats the tube to evaporate a solvent of the paint sprayed on the interior surface to harden the paint. The accumulator 6 stores the tube until the paint on the interior surface of the tube is dried. The prime coating printer 7 applies a base coating agent on the body of the tube by a rubber roll. The base coating agent applied by the prime coating printer 7 is dried in a dryer 11. However, the base coating agent is not completely dried at this time point. The offset printer 8 performs an offset printing operation on the base coating agent with a plurality of colors (e.g., six colors). The print and the base coating agent are completely dried in a dryer 12. The capping device 9 caps the mouth of the tube by applying a predetermined torque. The sealant applying device 10 applies latex to a predetermined portion of the hem portion of the tube, and allows a solvent (depending on the type of the latex) to evaporate. The basic construction of each of the devices is conventionally known and, therefore, will not be described in detail. Notable modifications for the production of the oval tube will be explained below.

Figure 2:
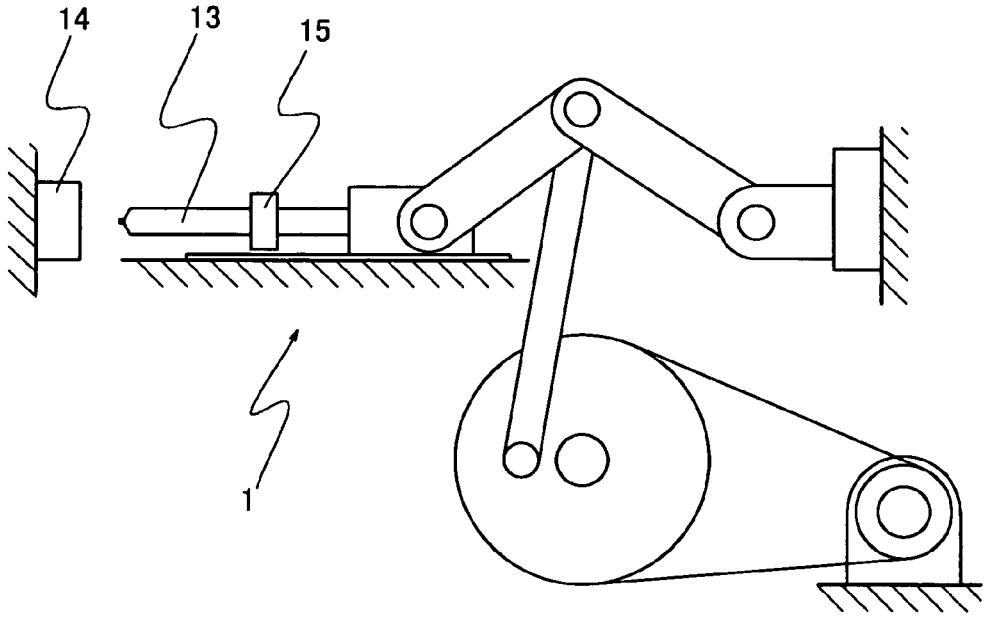
FIG. 2 is a schematic diagram of a toggle crank mechanism of an impact extrusion device.

As schematically illustrated in FIG. 2, the impact extrusion device 1 includes a cylindrical punch 13 having an axis, a press die 14, and a stripper 15 fitted around the punch 13 and movable axially of the punch 13. The punch 13 is moved toward and away from the die 14 by a lateral toggle crank press mechanism as shown in FIG. 2. The driving mechanism for the punch 13 is not limited to the press mechanism, but any other mechanism such as a link mechanism may be used. The die 14 and the stripper 15 are respectively fixed to bases.

Figure 4:
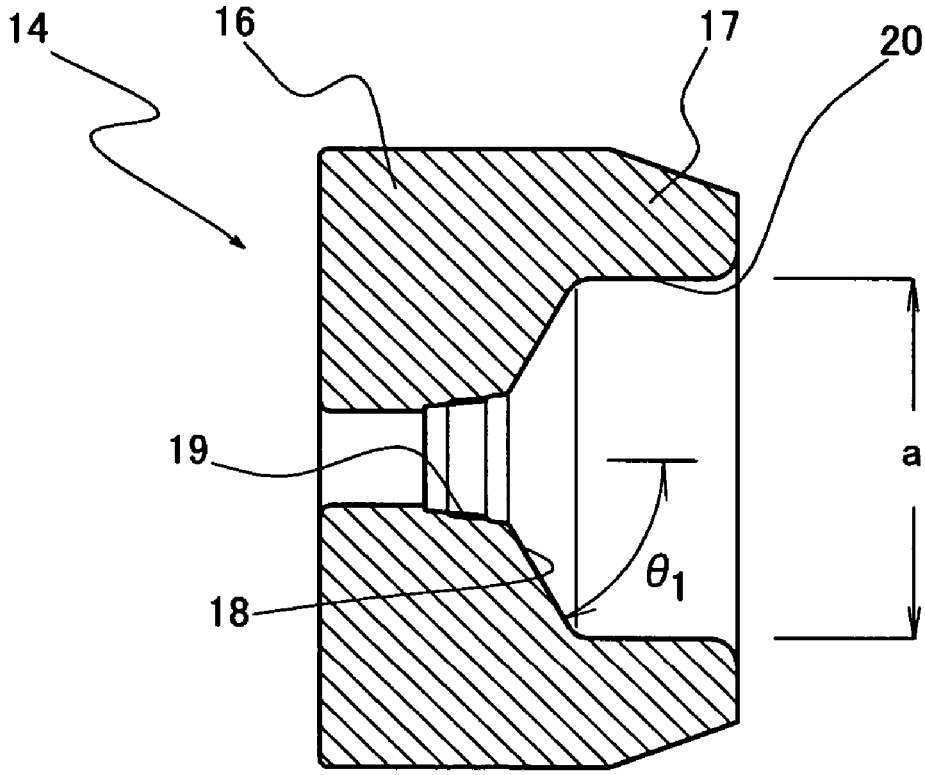
FIG. 4 is a sectional view taken along a line A—A in FIG. 3.
Figure 5:
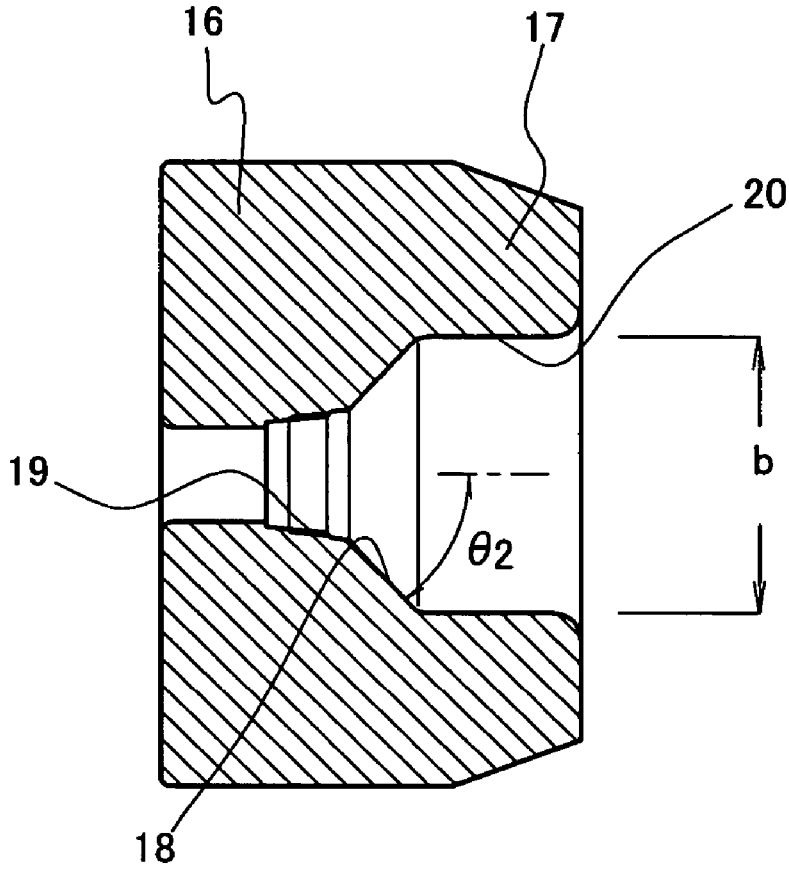
FIG. 5 is a sectional view taken along a line B—B in FIG. 3.

The die 14 for the impact press has a recess, and essentially includes a die base and a die ring. The die base and the die ring are generally provided separately, but may be unitarily provided as respectively indicated by reference numerals 16, 17 in FIGS. 3 to 5. The die base 16 has a taper surface 18 which defines an outer peripheral surface of the shoulder of the aluminum tube, and a mouth defining surface 19 which defines an outer surface of the mouth of the aluminum tube. An inner peripheral surface 20 of the die ring 17 has an oval cross section. The taper surface 18 connects the oval inner peripheral surface 20 of the die ring and the circular mouth defining surface 19. Therefore, the taper surface 18 also has an oval cross section. For example, generating lines of the taper surface 18 on diametrically opposite sides of the major axis of the taper surface each form an angle $\theta_1$ of about 60 degrees with respect to the axis, and generating lines on diametrically opposite sides of the minor axis each form an angle $\theta_2$ of about 47 degrees. The dimensional ratio of the minor axis b to the major axis a of the inner peripheral surface 20 of the die ring is about 0.76.

Figure 3:
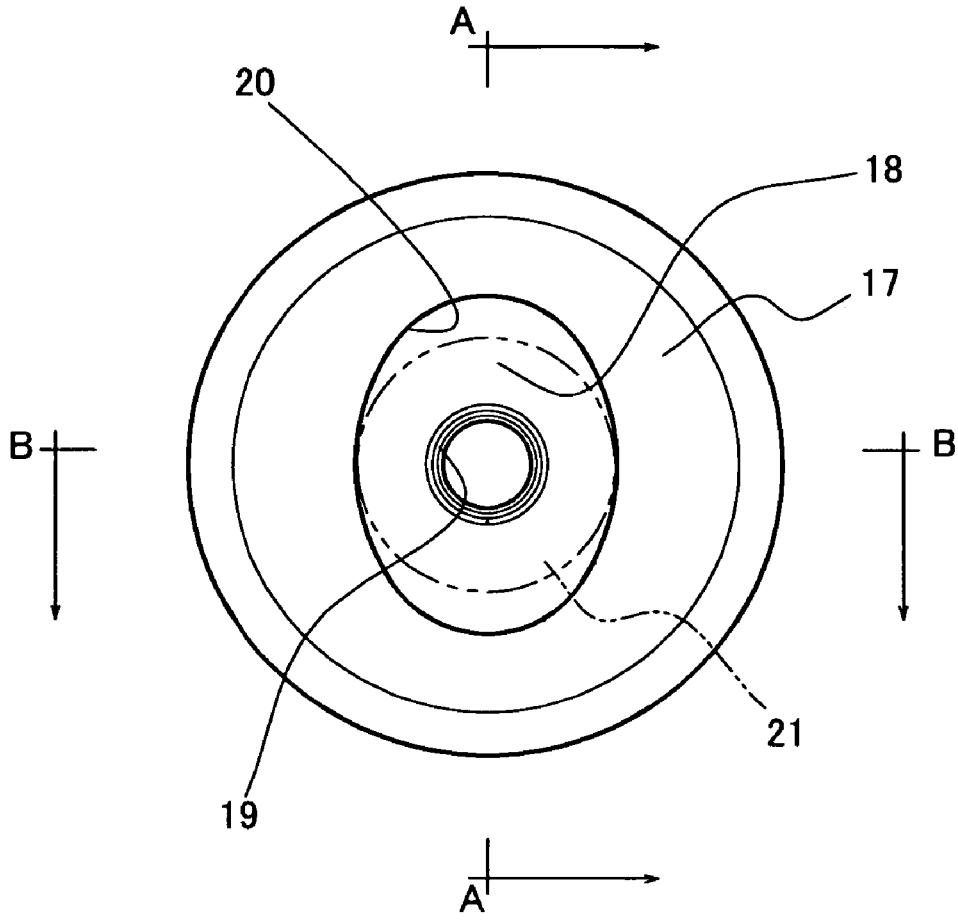
FIG. 3 is a front view of a press die according to one embodiment of the present invention.
Figure 6:
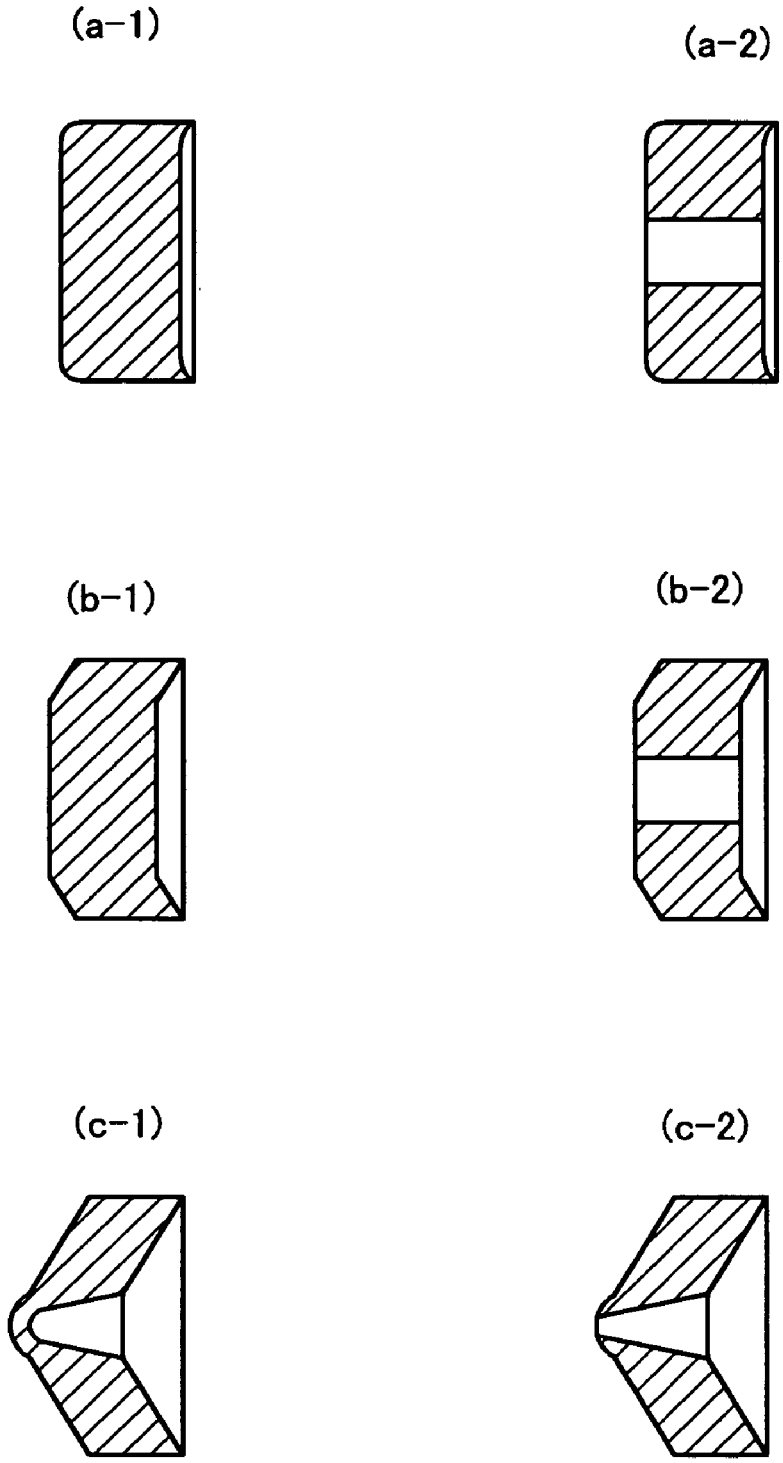
FIG. 6 is a plurality of sectional views illustrating various examples of a metal slug.

As indicated by a two-dot-and-dash line in FIG. 3, an aluminum slug 21 deburred and coated with a lubricant is placed in the die ring 17. The aluminum slug 21 may be prepared by punch-pressing an aluminum material continuously cast from an aluminum blast furnace and rolled at two stages by a rolling mill, and annealing the punch-pressed material, or by cutting upper and lower surfaces of an ingot to remove oxide films, rolling the resulting ingot to adjust the thickness of the material, punching the material by a punch press, and annealing the punched material. Conventionally known circular slugs as shown in FIG. 6 are usable. (a-1) and (a-2) illustrate planar slugs, and (b-1) and (b-2) illustrate dish-shaped slugs. (c-1) and (c-2) illustrate conical slugs. The slug 21 preferably has an outer diameter which is slightly smaller than the length of the minor axis of the inner peripheral surface 20 of the die ring.

Figure 7:
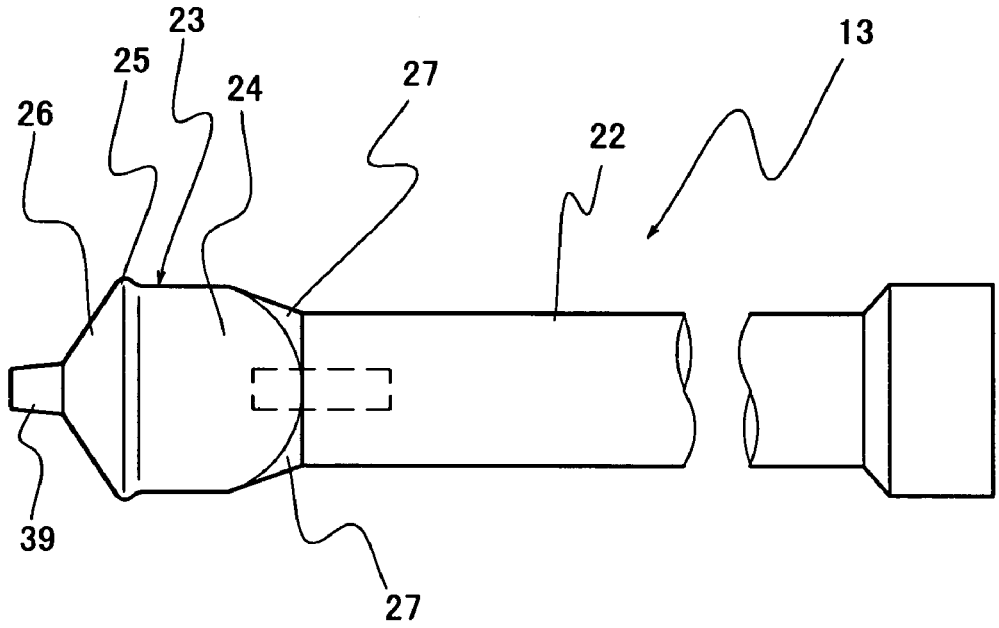
FIG. 7 is a side view of a punch according to the embodiment of the present invention as seen from one of diametrically opposite sides of the minor axis of the punch.
Figure 8:
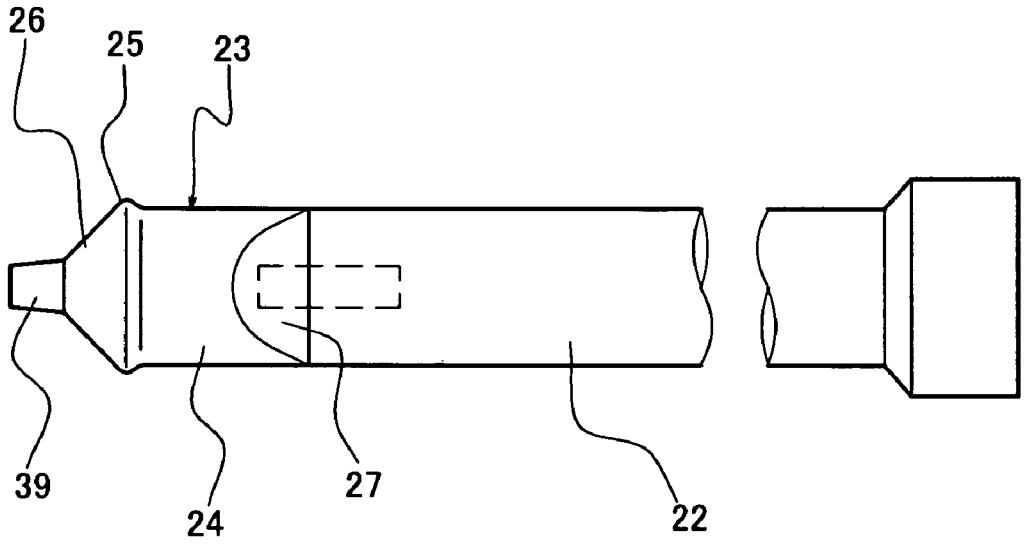
FIG. 8 is a side view of the punch as seen from one of diametrically opposite sides of the major axis of the punch.

As shown in FIGS. 7 and 8, the punch 13 essentially includes a circular cylindrical punch shaft 22, and a punch head 23 attached to a distal end of the punch shaft 22 by a joint bolt. The punch head 23 may be formed integrally with the shaft 22. However, the punch head 23 is preferably provided separately from the shaft 22 and detachable from the shaft 22 for replacement, because the punch head is subjected to great friction with aluminum thereby to be remarkably worn during the impact press. The punch head 23 includes a base 24 of an oval cross section connected to the punch shaft 22, a punch shoulder 25 provided at a distal end of the base 24 and having an oval cross section which has a greater diameter than the base 24, a first taper surface 26 having an oval cross section which has a diameter progressively decreasing toward a distal end thereof from the punch shoulder 25, and a punch nose 39 extending from a distal end of the taper surface 26 to a distal end of the punch head. The diameter of the punch shaft 23 is equal to the length of the minor axis of the base 24 of the punch head 23. The punch shoulder 25 has a cross section conformable to that of the inner peripheral surface 20 of the die ring. When the punch shoulder 25 is fitted in the die ring 17, a gap through which the slug is extruded for formation of the body of the tube is defined between the punch shoulder 25 and the die ring 17. The wall thickness of the body of the tube is determined by this gap. In this embodiment, the tube can be formed as having a small body wall thickness on the order of 0.11 mm to 0.13 mm even if having an oval shape.

In this embodiment, the die ring 17 and the punch head 23 each have an oval shape. Therefore, it is necessary to confirm that the punch head 23 is accurately positioned with respect to the die ring 17 and correct a positional offset and an angular offset, if any, when the punch head 23 is inserted to a several millimeters into the die ring 17 after replacement of the punch head 23 or before start up of the line.

The first taper surface 26 of the punch head 23 defines an interior surface of the shoulder of the tube, and conforms to the shape of the taper surface 18 of the die base 16. Generating lines of the first taper surface 26 on diametrically opposite sides of the major axis of the first taper surface each preferably form an angle of about 60 degrees with respect to the axis of the punch, and generating lines on diametrically opposite sides of the minor axis of the first taper surface 26 each preferably form an angle of about 49 degrees with respect to the axis of the punch. The inclination angles of the first taper surface 26 may be equal to the inclination angles of the shoulder defining taper surface 18 of the die base 16 throughout the circumference of the punch head. However, the inclination angles of the first taper surface 26 with respect to the axis may be smaller by about 1 degree to about 2 degrees than the inclination angles of the taper surface 18. Alternatively, the first taper surface 18 may have a step formed in a middle portion thereof, so that the inner surface of the shoulder is indented. Thus, the outer surface of the shoulder is curved as having a great curvature radius.

The punch head 23 has second taper surfaces 27 provided on proximal peripheral portions thereof on diametrically opposite sides of the major axis thereof and connected to the outer peripheral surface of the punch shaft 23. The taper surfaces 27 are helpful to smoothly release the product from the punch 13 by the stripper 15. Generating lines of the taper surfaces 27 on diametrically opposite sides of the major axis of the punch head preferably each form an angle of 10 degrees to 60 degrees with respect to the axis of the punch.

Figure 9:
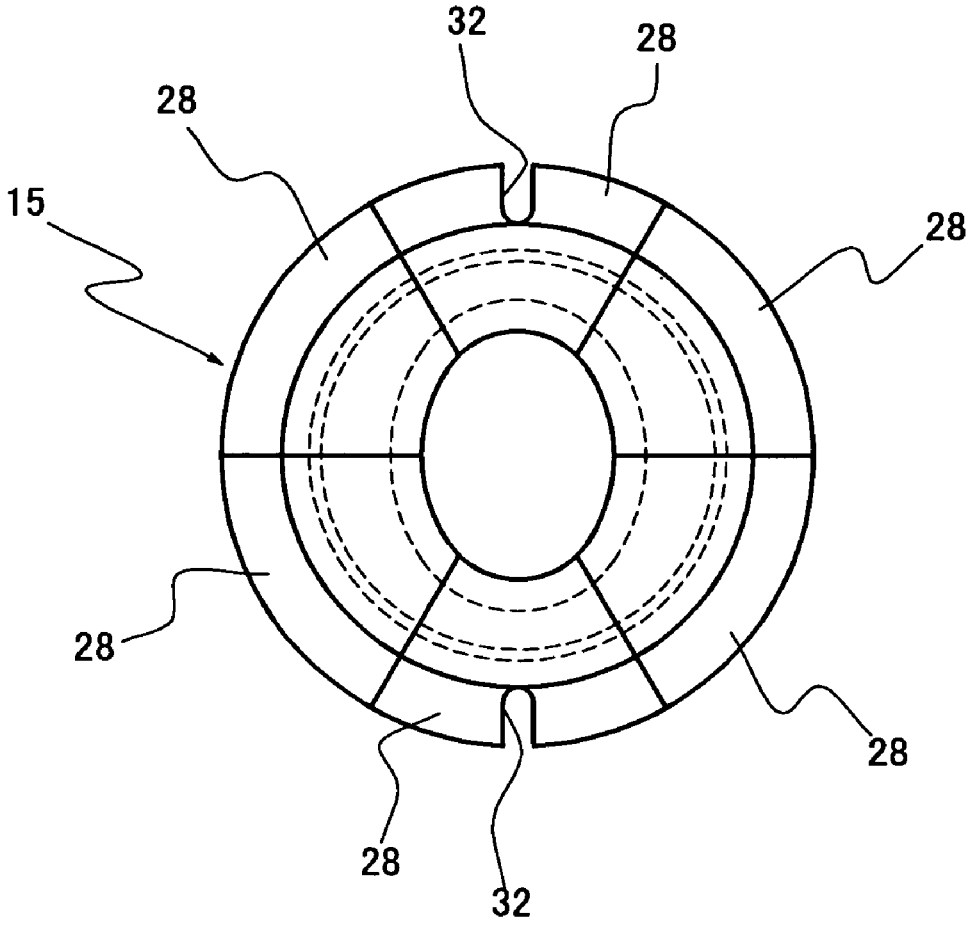
FIG. 9 is a front view of an exemplary stripper according to the embodiment of the present invention.
Figure 10:
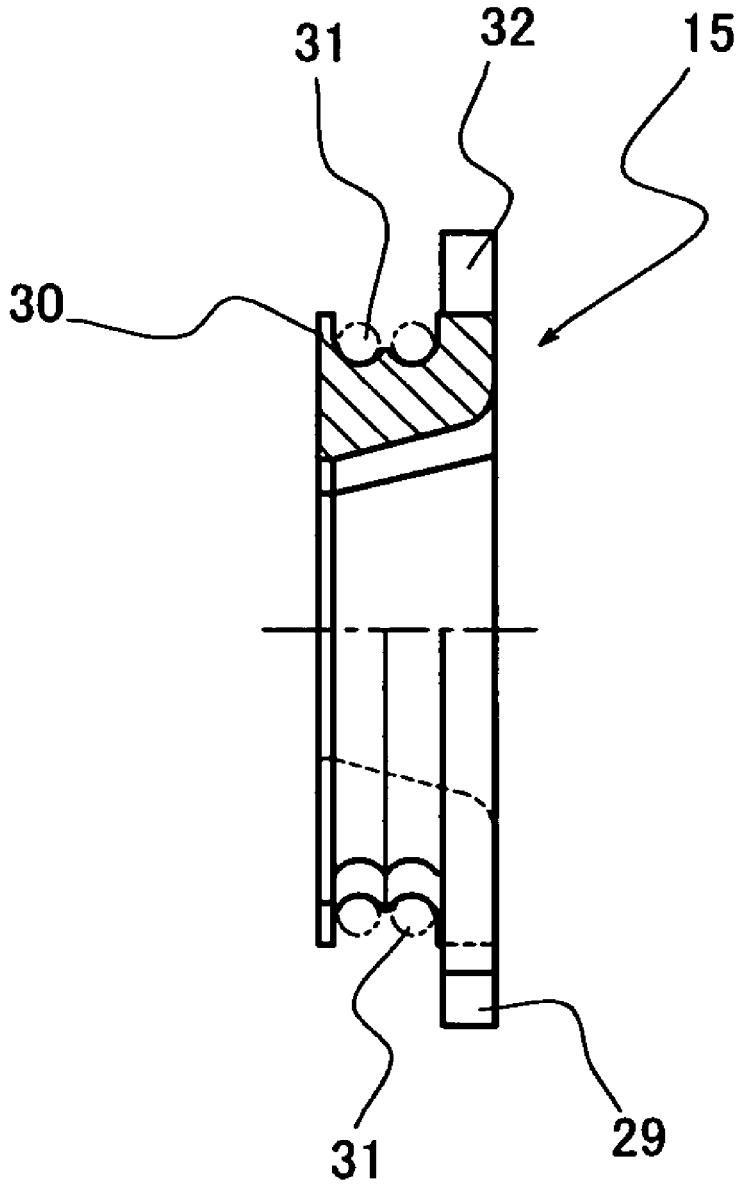
FIG. 10 is a side view illustrating the stripper partly in section.

FIGS. 9 and 10 illustrate an example of the stripper 15. The stripper 15 has a ring shape as a whole, and has a through-hole provided at the center thereof and having an oval shape which conforms to the outer peripheral shape of the base 24 of the punch head 23. More specifically, the stripper 15 includes six fan-shaped segments 28 circumferentially arranged, and a combination of the six segments 28 defines the ring shape. The segments 28 each have two flanges 29, 30 provided in axially spaced relation. A ring-shaped biasing member 31 such as a coil spring is fitted between the flanges 29 and 30. The biasing member 31 is fitted over all the segments 28 to bias the segments 28 radially inward. The segments 28 are movable radially outward against a biasing force of the biasing member 31. Distal edges of inner peripheral surfaces of the segments 28 each have an arcuate shape which conforms to the shape of the outer periphery of the base 24 of the punch head 23 or the shape of the outer periphery of the punch shoulder 25. The stripper 15 preferably further includes rotation preventing portions 32 such as key grooves provided at predetermined circumferential positions thereof for preventing rotation of the stripper 15 about the axis. A stripper holder (not shown) which fixes the stripper 15 to a base is engaged with the rotation preventing portion 32.

Figure 11:
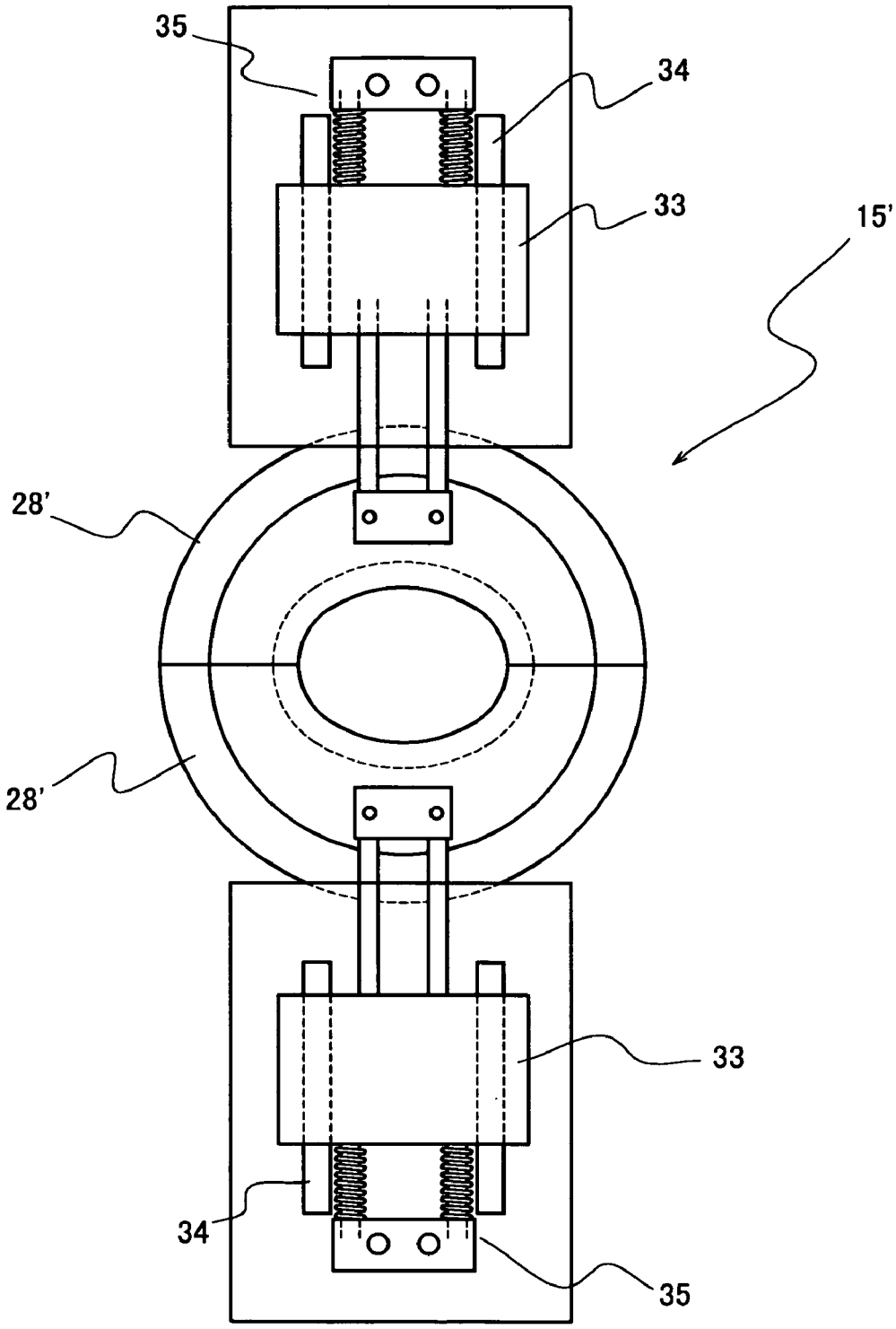
FIG. 11 is a front view illustrating another exemplary stripper.
Figure 12:
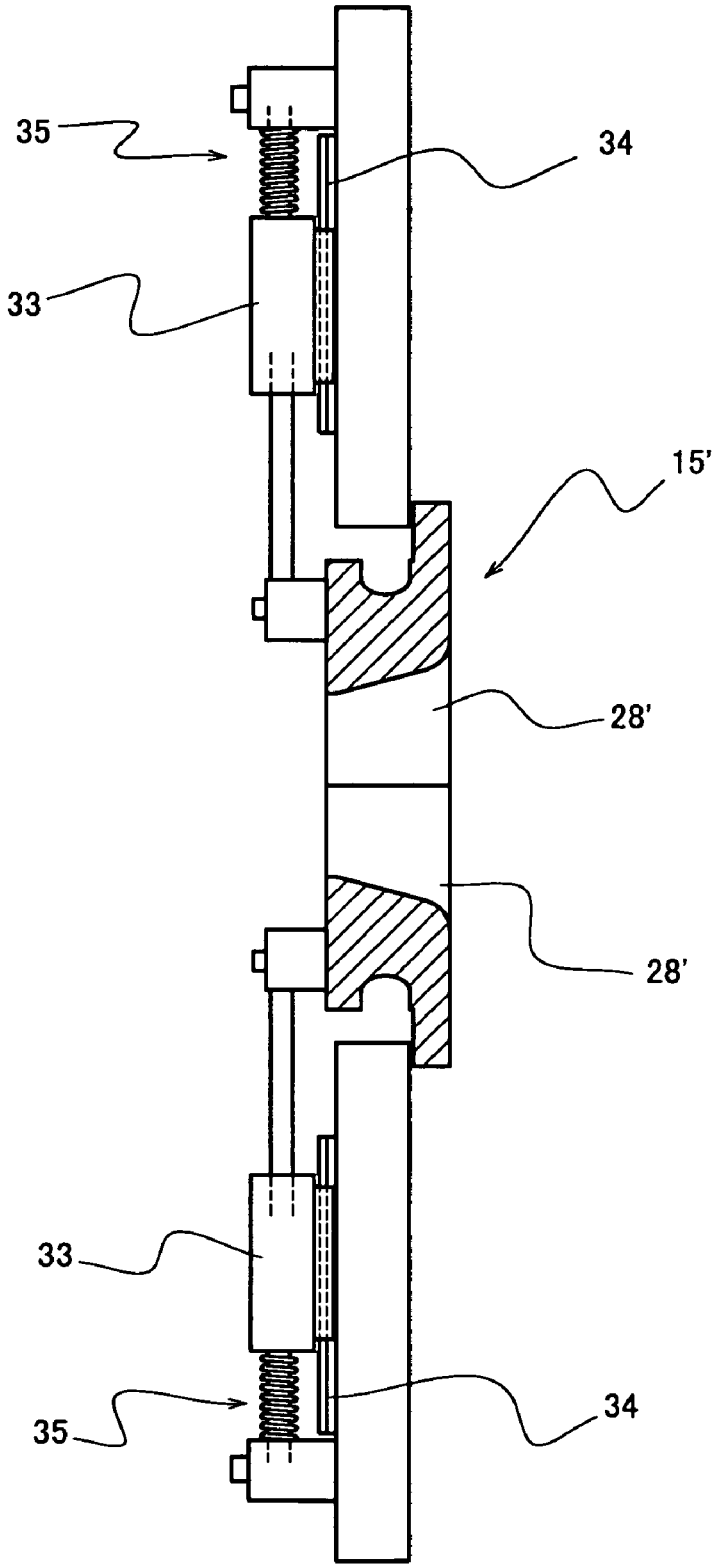
FIG. 12 is a side view illustrating the stripper partly in section.

FIGS. 11 and 12 illustrate another example 15' of the stripper. The stripper 15' essentially includes two segments 28' disposed in diametrically opposed relation.

The segments 28' are respectively radially movable by driving air cylinders 33. The air cylinders 33 are each attached to rails 34 so as to be axially slidable, and supported by a damper mechanism 35 so as to be retracted radially outward when an excess load is applied thereto. Distal edges of inner peripheral surfaces of the segments 28' each have a semi-oval arcuate shape which conforms to the shape of the outer periphery of the base of the punch head or the shape of the outer periphery of the punch shoulder 25.

Figure 13:
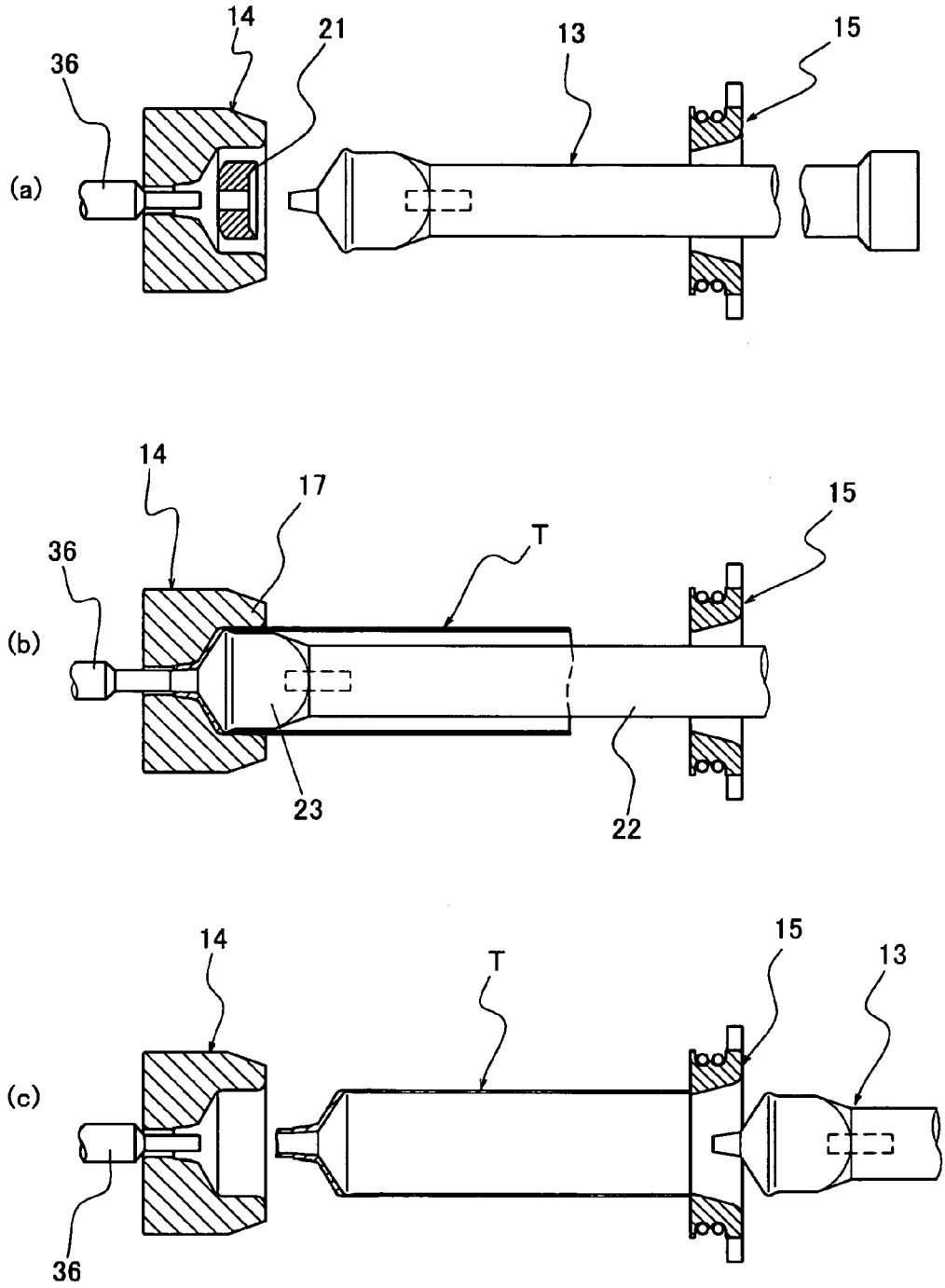
FIG. 13 is plurality of schematic process diagrams of an impact press process.

FIG. 13 is process diagram of the impact press process. FIG. 13(*a*) illustrates a state where the aluminum slug 21 is placed in the die 14 before the press, and FIG. 13(*b*) illustrates a state where the slug is impact-pressed by inserting the punch 13 into the die 14 to form the tube T. FIG. 13(*c*) illustrates a state where the tube T is released by protruding an ejector pin 36 and retracting the punch 13. In this embodiment, the die ring 17 and the punch head 23 each have an oval shape, and the inclination angles of the shoulder on the diametrically opposite sides of the minor axis and the major axis of the shoulder are optimized. Thus, the aluminum tube T having an oval cross section can be provided by the impact press, while the loss of the hem portion of the tube is suppressed to about 5 mm. By using the segmented stripper 15, 15', the hem portion of the oval tube can be assuredly pushed away from the punch 13 when the tube is released. Thus, the release of the tube can be smoothly achieved, even though the tube has an oval shape.

Figure 14:
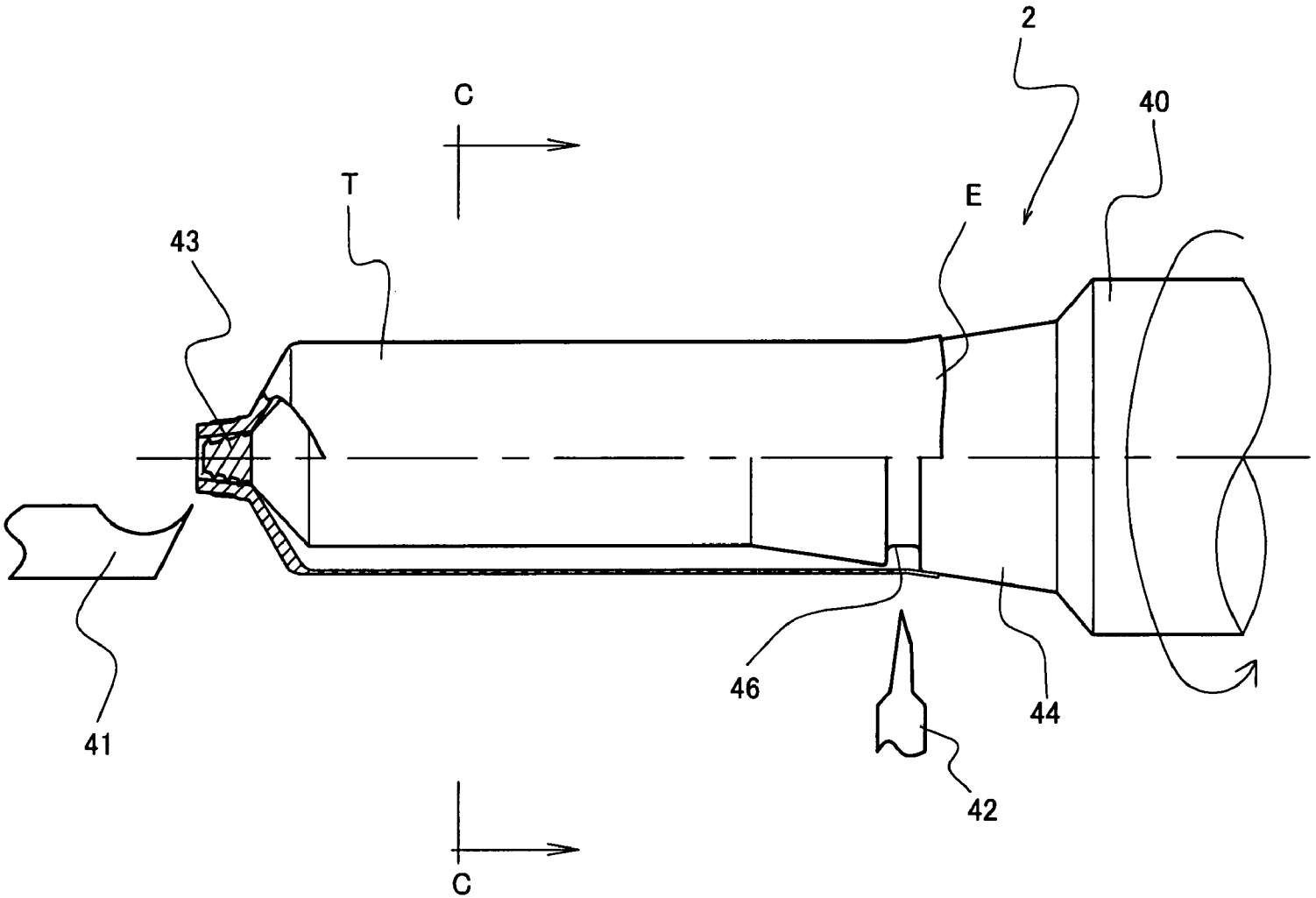
FIG. 14 is a schematic side view illustrating an exemplary trimming device partly in section.
Figure 15:
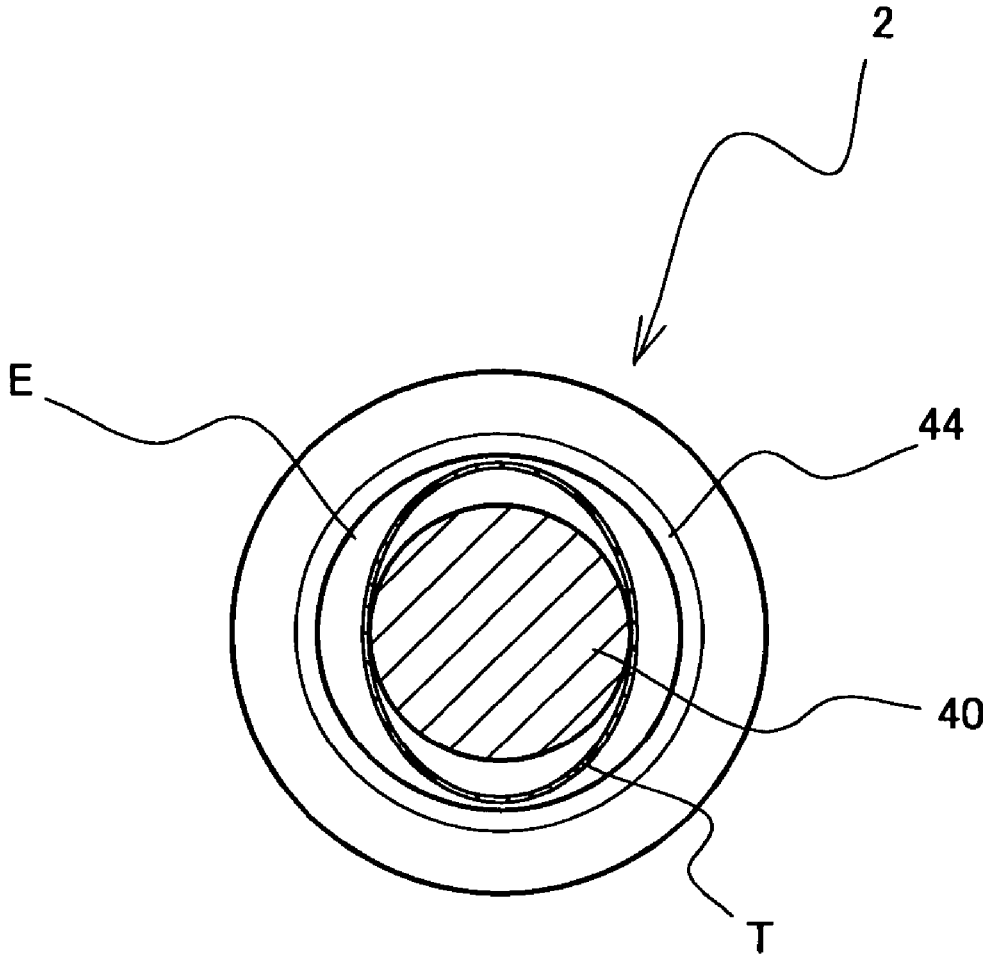
FIG. 15 is a sectional view taken along a line C—C in FIG. 14.

As shown in FIGS. 14 and 15, the trimming device 2 includes a mandrel 40 around which the aluminum tube T formed by the impact extrusion device 1 is fitted, an upper mouth surface cutting bite 41 which cuts off an upper mouth surface of the tube, and a trimming bite 42 (cutting tool) which cuts the hem portion of the tube. The mandrel 40 is driven to be rotated for cutting the tube. In the illustrated embodiment, a mandrel tip method is used for transmitting the rotation of the mandrel 40 to the tube T. In this method, a mandrel tip 43 having a projection and a groove cut spirally in a direction opposite from the rotation direction of the mandrel 40 is engaged in the inner peripheral surface of the mouth of the tube T to hold the aluminum tube T. Alternatively, an expansion mandrel method may be used. In this method, a mandrel is inserted into the aluminum tube, and distal end of the mandrel is expanded to hold the interior surface of the aluminum tube.

The mandrel 40 includes a taper portion 44 provided on a proximal portion thereof and having a truncated conical shape which has a diameter progressively decreasing toward a distal end thereof. A proximal end of the taper portion 44 has a diameter which is greater than the diameter of the interior surface of the body of the aluminum tube T, and the distal end of the taper portion 44 has a diameter which is substantially equal to the length of the minor axis of the interior surface of the body of the aluminum tube T. The mandrel is designed such that the hem portion E of the tube is flared into a circular shape by the taper portion 44 when the aluminum tube T is fitted around the mandrel 40. The trimming bite 42 cuts the hem portion of the tube at an axially middle position of the taper portion 44. In order to smoothly cut the bite 42, the taper portion 44 of the mandrel 40 has a groove 46 (a bite clearance) provided at a predetermined axial position in association with the bite 42 as extending circumferentially thereof.

Therefore, the hem portion of the tube is trimmed by the bite 42 disposed at a fixed position while the metal tube is rotated by the rotation of the mandrel 40. After completion of the trimming, the hem portion of the tube is restored into the oval shape by a proper restoring device before an annealing operation is performed by the annealing device 3. The construction and position of the restoring device are not particularly limited. Where a ring (not shown) having an oval shape which conforms to the outer peripheral shape of the oval tube body may be disposed around the distal end of the mandrel 40, for example, the hem portion is restored into the oval shape by the ring when the tube T is withdrawn from the mandrel 40. Alternatively, the restoration may be achieved by pinching the hem portion from the diametrically opposite sides of the minor axis of the tube during transportation of the tube to the annealing device 3.

Though not shown, the trimming device 2 includes a screw roll for forming a thread on an outer peripheral surface of the mouth of the tube by a rolling operation.

Figure 16:
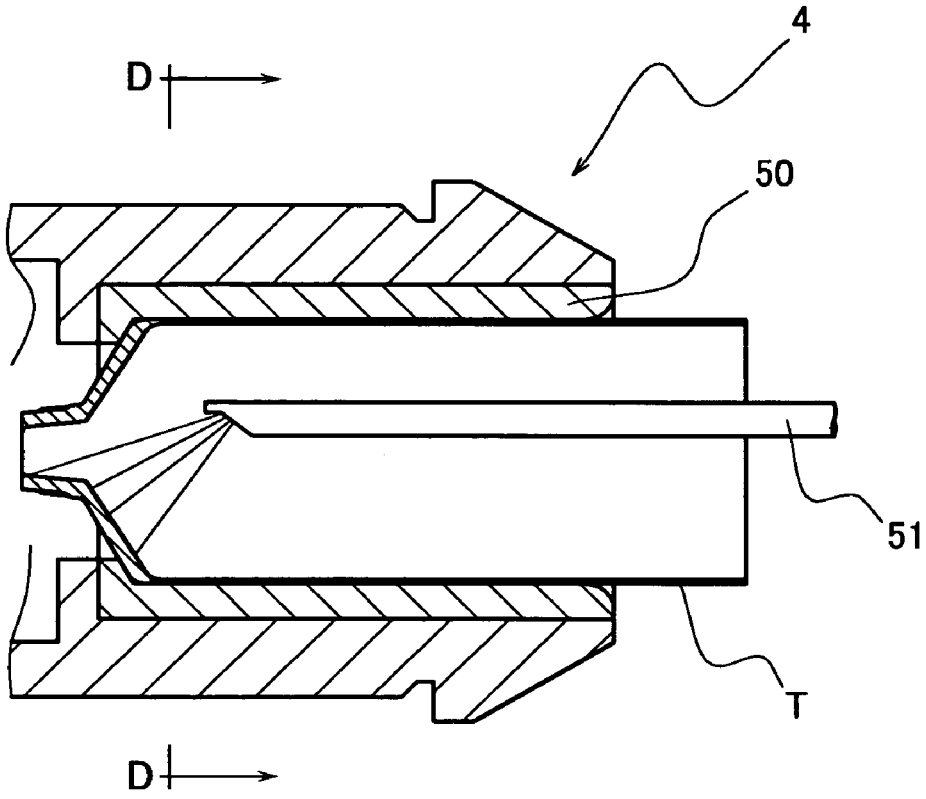
FIG. 16 is a sectional view of an oval tube taken along the major axis of the tube for explaining an exemplary interior coating device.
Figure 17:
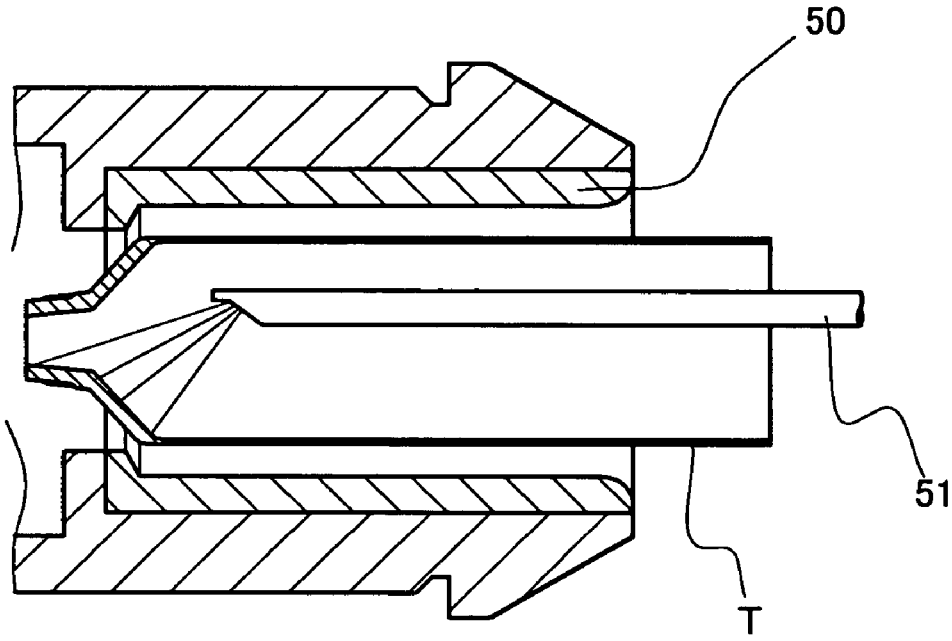
FIG. 17 is a sectional view of the oval tube taken along the minor axis of the tube for explaining the interior coating device.
Figure 18:
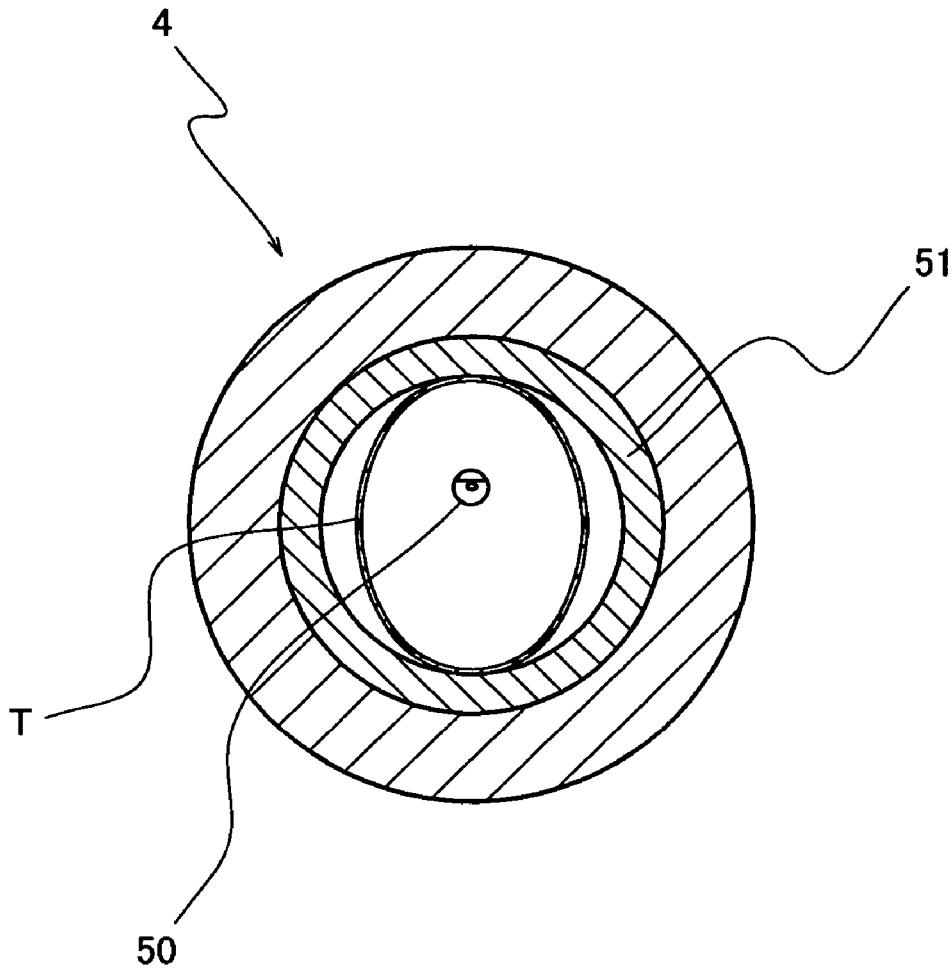
FIG. 18 is a sectional view taken along a line D—D in FIG. 16.

As shown in FIGS. 16 to 18, the interior coating device 4 has substantially the same basic construction as a conventional device, but a special holder 50 having an inner diameter which is equal to the length of the major axis of the oval tube T plus 0.1 mm to 0.5 mm is required. Since a spray gun 51 is spaced different distances from the tube on the diametrically opposite sides of the major axis of the tube and on the diametrically opposite sides of the minor axis of the tube, the coating is liable to be uneven. Therefore, the spray angle is preferably adjusted such that an interior coating agent is sprayed more directly toward the distal edge (shoulder) of the tube, as compared with the conventional circular tube. An epoxy paint or a phenol paint is usable as the interior coating agent. Examples of the epoxy paint include an epoxy-amino resin prepared by adding a melamine resin to an epoxy resin, and an epoxy-phenol resin prepared by adding a thermosetting phenol resin to an epoxy resin. Examples of the phenol paint include a phenol resin prepared by modifying an alcohol-soluble phenol resin with a thermoplastic resin such as a butyral resin.

The holder 50 is driven to be rotated at a high speed. While the spray gun 51 is retracted from a distal end (adjacent to the shoulder of the tube) with the aluminum tube being rotated together with the holder, the paint is sprayed for the painting of the interior surface. The paint spraying operation is preferably performed twice or more times for formation of a uniform coating film. It is preferred to perform the spraying operation at least once by means of a spray gun adapted for coating of the oval body and perform the spraying operation at least once by means of a spray gun adapted for coating of the shoulder and the mouth. Where a relatively thick coating film is to be uniformly formed, it is preferred to perform an intermediate drying operation at a predetermined temperature (e.g., at about 10° C.) to evaporate a solvent after the first spraying operation, and then perform the second spraying operation.

The prime coating printer 7, the offset printer 8 and the sealant applying device 10 are preferably modified for the formation of the oval tube. Techniques for other oval products such as plastic oval tubes may be used for the modification of these devices.

According to the present invention, it is possible to provide the novel metal tube having an oval cross section. Since the body and the shoulder of the tube each have an oval cross section, the shoulder can be easily collapsed along the minor axis thereof. Although the conventional metal tube including the mouth, the shoulder and the body integrally formed has a disadvantage such that contents are likely to partly remain in the shoulder of the metal tube, the present invention eliminates this disadvantage. Since the metal tube has an oval shape, a multiplicity of such tubes can be efficiently stored by arranging the tubes in a proper direction. Further, the inventive metal tube has advantages as a metal tube and, at the same time, has an increased volume because of the oval cross section of the body thereof. In addition, the metal tube with a painted outer surface has an excellent appearance comparable to that of a plastic tube.

With the inventive device and method for the impact extrusion, the profile extrusion for the formation of the oval tube is achieved by optimizing the shapes of the die and the punch, and the material loss is reduced to a level comparable to that caused in the case where the conventional circular tube is formed by the impact press.

Although the punch is constituted essentially by the circular cylindrical punch shaft and the punch head having an oval cross section, the taper surfaces provided on the proximal peripheral portions of the punch head on the diametrically opposite sides of the major axis of the punch head and connected to the outer peripheral surface of the punch shaft makes it possible to smoothly release the tube.

What is claimed is:

1. A production apparatus for a metal tube having an oval cross section comprising:

an impact extrusion device which impact-extrudes a disk-shaped metal slug to form a metal tube integrally including a mouth, a shoulder and a body of an oval cross section; and a trimming device which trims a hem portion of the oval body of the tube formed by the impact extrusion device by a turning operation, wherein the impact extrusion device includes a columnar punch having an axis, a press die, and a stripper provided around the punch in an axially movable manner, wherein the punch includes a punch shaft, a punch head provided at a distal end of the shaft and including a punch shoulder, wherein the die includes a die base, and a die ring which retains the metal slug therein, wherein the punch shoulder has an outer surface having an oval cross section, and the die ring has an inner peripheral surface having an oval cross section, wherein the punch shoulder is insertable in the die ring, wherein the punch head includes a base of an oval cross section connected to the punch shaft, the punch shoulder which is provided at a distal end of the base and has a greater diameter than the base, and a first taper surface having an oval cross section which has a diameter progressively decreasing toward a distal end thereof from the punch shoulder, wherein generating lines of the first taper surface on diametrically opposite sides of a major axis of the first taper surface each form an angle of not smaller than 55 degrees and not greater than 65 degrees with respect to the axis of the punch, wherein generating lines of the first taper surface on diametrically opposite sides of a minor axis of the first taper surface each form an angle of not smaller than 43 degrees and not greater than 53 degrees with respect to the axis of the punch, wherein the outer surface of the shoulder and the inner peripheral surface of the die ring are each dimensioned so that a dimensional ratio of a minor axis to a major axis thereof is not smaller than 0.5 and not greater than 0.9.

2. A production apparatus for a metal tube having an oval cross section comprising:

an impact extrusion device which impact-extrudes a disk-shaped metal slug to form a metal tube integrally including a mouth, a shoulder and a body of an oval cross section; and a trimming device which trims a hem portion of the oval body of the tube formed by the impact extrusion device by a turning operation, wherein the impact extrusion device includes a columnar punch having an axis, a press die, and a stripper provided around the punch in an axially movable manner, wherein the punch includes a punch shaft, a punch head provided at a distal end of the shaft and including a punch shoulder, wherein the die includes a die base, and a die ring which retains the metal slug therein, wherein the punch shoulder has an outer surface having an oval cross section, and the die ring has an inner peripheral surface having an oval cross section, wherein the punch shoulder is insertable in the die ring, wherein the stripper includes a plurality of segments circumferentially arranged, the segments being each radially movable, wherein distal edges of inner peripheral surfaces of the segments each have an arcuate shape which conforms to an outer peripheral shape of the base of the punch head.

3. An oval cross section metal tube production apparatus as set forth in claim 2, further comprising a biasing member which biases the respective segments radially inward.

4. A production apparatus for a metal tube having an oval cross section comprising:

an impact extrusion device which impact-extrudes a disk-shaped metal slug to form a metal tube integrally including a mouth, a shoulder and a body of an oval cross section; and a trimming device which trims a hem portion of the oval body of the tube formed by the impact extrusion device by a turning operation, wherein the trimming device includes a mandrel around which the metal tube formed by the impact extrusion device is fitted, the mandrel being rotatable about an axis thereof, and a cutting tool which cuts the hem portion of the metal tube fitted around the mandrel, wherein the mandrel includes a taper portion having a truncated conical shape which has a diameter progressively decreasing toward a distal end thereof, wherein a proximal portion of the taper portion has a diameter greater than a length of a major axis of an inner peripheral surface of the body of the metal tube, wherein the hem portion of the metal tube is cut at an axially middle position of the taper portion by the cutting tool, wherein the hem portion of the metal tube fitted around the mandrel is flared into a circular shape by the taper portion, wherein the metal tube having the flared hem portion is rotated relative to the cutting tool by the rotation of the mandrel, whereby the hem portion of the tube is circumferentially cut by the cutting tool.

5. An oval cross section metal tube production apparatus as set forth in claim 4, wherein the taper portion of the mandrel has a groove provided in an outer peripheral surface thereof in association with the cutting tool as extending circumferentially thereof.

6. An oval cross section metal tube production apparatus as set forth in claim 4, further comprising:

an annealing device which anneals the metal tube formed and hardened by the impact extrusion performed by the impact extrusion device; and a restoration device which restores the hem portion of the tube deformed into the circular shape by the mandrel of the trimming device into the oval shape, wherein the annealing device anneals the metal tube with the hem portion of the metal tube restored into the oval shape.

7. A production method for a metal tube having an oval cross section comprising the steps of:

impact-extruding a disk-shaped metal slug to form a metal tube integrally including a mouth, a shoulder and a body of an oval cross section; and trimming a hem portion of the oval body of the tube formed in the impact extrusion step by a turning operation, wherein the impact extrusion step is performed by an impact extrusion device including a columnar punch having an axis, a press die and a stripper provided around the punch in an axially movable manner, wherein the punch includes a punch shaft, and a punch head provided at a distal end of the shaft and including a punch shoulder, wherein the die includes a die base, and a die ring which retains the metal slug therein, wherein the punch shoulder has an outer surface having an oval cross section, and the die ring has an inner peripheral surface having an oval cross section, wherein the punch shoulder is insertable in the die ring, wherein the punch head includes a base of an oval cross section connected to the punch shaft, the punch shoulder which is provided at a distal end of the base and has a greater diameter than the base, and a first taper surface having an oval cross section which has a diameter progressively decreasing toward a distal end thereof from the punch shoulder, wherein generating lines of the first taper surface on diametrically opposite sides of a major axis of the first taper surface each form an angle of not smaller than 55 degrees and not greater than 65 degrees with respect to the axis of the punch, wherein generating lines of the first taper surface on diametrically opposite sides of a minor axis of the first taper surface each form an angle of not smaller than 43 degrees and not greater than 53 degrees with respect to the axis of the punch, wherein the outer surface of the shoulder and the inner peripheral surface of the die ring are each dimensioned so that a dimensional ratio of a minor axis to a major axis thereof is not smaller than 0.6 and not greater than 0.9.

8. A production method for a metal tube having an oval cross section comprising the steps of:

impact-extruding a disk-shaped metal slug to form a metal tube integrally including a mouth, a shoulder and a body of an oval cross section; and trimming a hem portion of the oval body of the tube formed in the impact extrusion step by a turning operation, wherein the impact extrusion step is performed by an impact extrusion device including a columnar punch having an axis, a press die and a stripper provided around the punch in an axially movable manner, wherein the punch includes a punch shaft, and a punch head provided at a distal end of the shaft and including a punch shoulder, wherein the die includes a die base, and a die ring which retains the metal slug therein, wherein the punch shoulder has an outer surface having an oval cross section, and the die ring has an inner peripheral surface having an oval cross section, wherein the punch shoulder is insertable in the die ring, wherein the stripper includes a plurality of segments circumferentially arranged, the segments being each radially movable, wherein distal edges of inner peripheral surfaces of the segments each have an arcuate shape which conforms to an outer peripheral shape of the base of the punch head, wherein a proximal portion of the metal tube formed to be filled around the punch by the impact extrusion is pushed toward a distal end of the punch by the stripper, whereby the metal tube is released from the punch.

9. An oval cross section metal tube production method as set forth in claim 8, wherein the segments are biased radially inward during the releasing.

10. A production method for a metal tube having an oval cross section comprising the steps of:

impact-extruding a disk-shaped metal slug to form a metal tube integrally including a mouth, a shoulder and a body of an oval cross section; and trimming a hem portion of the oval body of the tube formed in the impact extrusion step by a turning operation, wherein the hem portion of the metal tube which is formed and hardened in the impact extrusion step is deformed into a substantially perfectly circular shape and, after the hem portion is restored into an oval shape, the metal tube is annealed in the trimming step.

11. An oval cross section metal tube production method as set forth in claim 10, wherein the circular shape of the hem portion is cut by a trimming bite that is in a fixed position with the metal tube rotated relative to the trimming bite.

12. A production method for a metal tube having an oval cross section comprising the steps of:

impact-extruding a disk-shaped metal slug to form a metal tube integrally including a mouth, a shoulder and a body of an oval cross section; and trimming a hem portion of the oval body of the tube formed in the impact extrusion step by a turning operation, wherein the trimming step is performed by a trimming device including a mandrel around which the metal tube formed in the impact extrusion step is fitted, the mandrel being rotatable about an axis thereof, and a cutting tool which cuts the hem portion of the metal tube fitted around the mandrel, wherein the mandrel includes a taper portion having a truncated conical shape which has a diameter progressively decreasing toward a distal end thereof, wherein a proximal portion of the taper portion has a diameter greater than a length of a major axis of an inner peripheral surface of the body of the metal tube, wherein the hem portion of the metal tube is cut at an axially middle portion of the taper portion by the cutting tool, wherein the hem portion of the metal tube fitted around the mandrel is flared into a circular shape by the taper portion, wherein the metal tube having the flared hem portion is rotated relative to the cutting tool by the rotation of the mandrel, whereby the hem portion of the tube is circumferentially cut by the cutting tool.

13. An oval cross section metal tube production method as set forth in claim 12, wherein the taper portion of the mandrel has a groove provided in an outer peripheral surface thereof in association with the cutting tool as extending circumferentially thereof, whereby the cutting tool is permitted to intrude into the groove during the cutting.

14. An oval cross section metal tube production method as set forth in claim 12, further comprising the steps of:

annealing the metal tube which is formed and hardened by the impact extrusion performed by the impact extrusion device; and restoring the hem portion of the tube deformed into the circular shape by the mandrel of the trimming device into the oval shape, wherein the annealing step follows the restoring step.

* * * * *

UNITED STATES PATENT AND TRADEMARK OFFICE

CERTIFICATE OF CORRECTION

PATENT NO. : 7,219,522 B2
APPLICATION NO. : 10/522217
DATED : May 22, 2007
INVENTOR(S) : Yuji Maeda et al.

It is certified that error appears in the above-identified patent and that said Letters Patent is hereby corrected as shown below:

On The Title Page, Item (73)
The name of the Assignee should be spelled as follows:

--TAISEI KAKO CO., LTD.--

Column 15, line 40, “filled” should be --fitted--.

Signed and Sealed this

Sixth Day of November, 2007

JON W. DUDAS
*Director of the United States Patent and Trademark Office*